US010088778B2

(12) United States Patent
Yuasa et al.

(10) Patent No.: US 10,088,778 B2
(45) Date of Patent: Oct. 2, 2018

(54) IMAGE FORMING APPARATUS HAVING A TONER DISCHARGING PORTION AND A COVER

(71) Applicant: CANON KABUSHIKI KAISHA, Tokyo (JP)

(72) Inventors: Masato Yuasa, Kashiwa (JP); Tomoharu Kitajima, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/498,579

(22) Filed: Apr. 27, 2017

(65) Prior Publication Data

US 2017/0315476 A1 Nov. 2, 2017

(30) Foreign Application Priority Data

Apr. 28, 2016 (JP) ..... 2016-091307

(51) Int. Cl.
*G03G 15/08* (2006.01)

(52) U.S. Cl.
CPC ..... *G03G 15/0891* (2013.01); *G03G 15/0865* (2013.01)

(58) Field of Classification Search
CPC ... G03G 2215/0675; G03G 2215/0663; G03G 2215/0665; G03G 2215/0678
See application file for complete search history.

(56) References Cited

U.S. PATENT DOCUMENTS 5,557,382 A * 9/1996 Tatsumi ..... G03G 15/0868 222/DIG. 1
6,091,912 A * 7/2000 Kitajima ..... G03G 15/0872 399/119

FOREIGN PATENT DOCUMENTS

| | | | |
|---|---|---|---|
| JP | H11-327275 | A | 11/1999 |
| JP | 2003-233248 | A | 8/2003 |
| JP | 2005-077564 | A | 3/2005 |
| JP | 2013-171065 | A | 9/2013 |

* cited by examiner

*Primary Examiner* — Victor Verbitsky
(74) *Attorney, Agent, or Firm* — Fitzpatrick, Cella, Harper & Scinto

(57) ABSTRACT

An image forming apparatus includes an image developer unit to develop an electrostatic latent image formed on an image bearing member, using toner, and a toner container detachably mounted to a main assembly. The toner container includes a toner discharging portion having a toner discharge opening, and a storage container to store the discharge toner and to supply the stored toner. The toner discharging portion extends at least partly in the storage container through an opening of the storage container, and a cover covers the toner discharging portion and extends inwardly from an inside of a wall of the storage container, at least below the toner discharging portion. A length L1 by which the cover extends from the wall inwardly of the storage container, and a length L2 by which the toner discharging portion extends from the opening inwardly of the storage container satisfy L1<L2.

5 Claims, 16 Drawing Sheets

IMAGE FORMING APPARATUS HAVING A TONER DISCHARGING PORTION AND A COVER

FIELD OF THE INVENTION AND RELATED ART

The present invention relates to an image forming apparatus such as a copying machine, a printing machine, etc., that uses an electrophotographic method, an electrostatic recording method, or the like.

Heretofore, in an image forming apparatus which uses an electrophotographic method or the like, toner is adhered to an electrostatic latent image to develop the latent image. In a developing apparatus for developing an electrostatic latent image, toner is consumed. Thus, a developing apparatus is replenished with toner with the use of a replenishment toner container (which hereafter may be referred to as "toner cartridge"). A toner cartridge is structured so that it can be removably installed in the main assembly of an image forming apparatus. It is replaced as it runs out of the toner therein.

As a toner cartridge runs out of the toner therein, it fails to replenish a developing apparatus with toner, sometimes making it necessary for an on-going printing job to be interrupted. Thus, an image forming apparatus which uses an electrophotographic method or the like is structured so that its developing device is not directly replenished with toner from a toner cartridge; it is provided with a developer delivering apparatus (which hereafter may be referred to as "hopper"), which has a toner storing portion and is disposed between the toner cartridge and developing apparatus. A hopper is provided with a toner storage portion (Japanese Laid-open Patent Application No. 2013-171065). Thus, as the toner cartridge in the main assembly of the image forming apparatus runs out of toner, it can be replaced without interrupting the on-going printing job (this procedure of replacing toner cartridge without interrupting on-going printing job may be referred to as "continuous run"). That is, with the main assembly of an electrophotographic image forming apparatus being equipped with a hopper, it does not occur that as soon as the toner cartridge in the main assembly of the image forming apparatus becomes empty, it becomes impossible for the developing apparatus to be replenished with toner. Thus, all that is necessary to be done not to interrupt the on-going printing operation is to replace the toner cartridge in the main assembly before the toner in the hopper is completely consumed.

There is a "trade-off" relationship between the hopper size (nearly equal to an amount of toner in hopper) and length of "continuous run". In order to reduce an electrophotographic image forming apparatus in size, a hopper is desired to be as small as possible, making it unacceptable to increase a hopper in size to increase an electrophotographic image forming apparatus in the length of "continuous run". One of the solutions to this dilemma is to come up with a method for increasing the amount by which toner can be held in a hopper. As toner is delivered into a hopper, it accumulates in the hopper roughly in a manner to form a cone, the angle of its side wall of which relative to its bottom is equal to the angle of repose of toner. Thus, from the standpoint of increasing the amount by which toner can be held in the hopper, it is effective to discharge the toner from a toner cartridge to roughly the center of the hopper. In order to discharge the toner from a toner cartridge to roughly the center of a hopper, it is effective to structure the developing apparatus and toner cartridge so that as a toner cartridge is installed into the main assembly of an electrophotographic image forming apparatus, the toner outlet of the toner delivery portion of the toner cartridge reaches roughly the center of the hopper.

On the other hand, increasing the amount by which toner can be held in a hopper to increase an electrophotographic image forming apparatus in the length of "continuous run" makes it likely for the toner delivery portion of a toner cartridge to come into contact with the toner in the hopper, making it therefore likely for the toner to adhere to the toner delivery portion of the toner cartridge.

By the way, there is an issue similar to the above-described one, in a case where a developing apparatus is replenished with two-component developer having toner and carrier, or with carrier.

SUMMARY OF THE INVENTION

Thus, the primary object of the present invention is to provide an electrophotographic image forming apparatus which is structured so that the toner delivery portion of a replenishment developer container is inserted into the toner storing portion of the developer delivering apparatus of the image forming apparatus, and yet, the toner delivery portion of the replenishment developer container is not soiled by the toner.

According to an aspect of the present invention, there is provided an image forming apparatus comprising an image bearing member; a developing device configured to develop an electrostatic latent image formed on said image bearing member; a developer supply container including an accommodating portion configured to accommodate a developer, a projected portion projected from said accommodating portion, and a discharge opening configured to permit discharge of the developer; and a developer supplying device configured to store the developer to be supplied to said developing device, wherein said developer supply container is mounted to said developer supplying device, said developer supplying device including i) a storage portion configured to store the developer, ii) an opening configured to insert said projected portion into said storage portion, iii) an abutting portion abutting to said developer supply container to set said projected portion at a predetermined position relative to said storage portion, iv) a shield portion at least a part of which is vertically below said projected portion of said developer supply container, and wherein shield portion satisfies $L1>L2\times0.8$, and $D2>D1$, where L1 is a length of said shield portion measured in an inserting direction in which said projected portion is inserted through said opening, L2 is a length of said projected portion inserted in said storage portion, D1 is a maximum width of said projected portion measured in a direction perpendicular to the inserting direction, and D2 is a width of said shield portion measured in a direction perpendicular to the inserting direction.

Further features of the present invention will become apparent from the following description of exemplary embodiments (with reference to the attached drawings).

Figure 9:
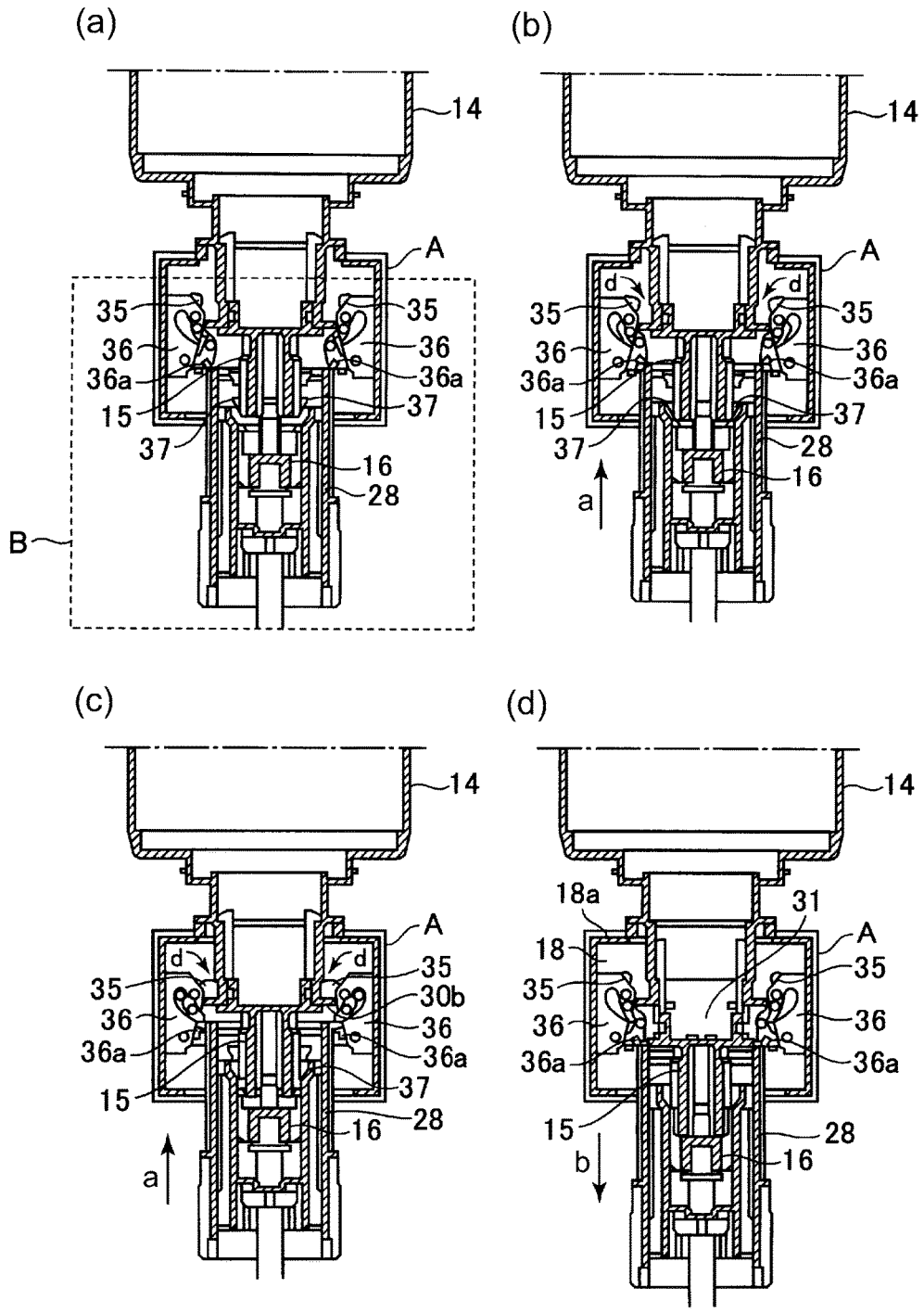

Parts (a), (b), (c) and (d) of FIG. 9 are sectional views of a combination of the toner cartridge and rotational mechanism, which is for describing the operation for opening or closing the toner cartridge.

Figure 10:
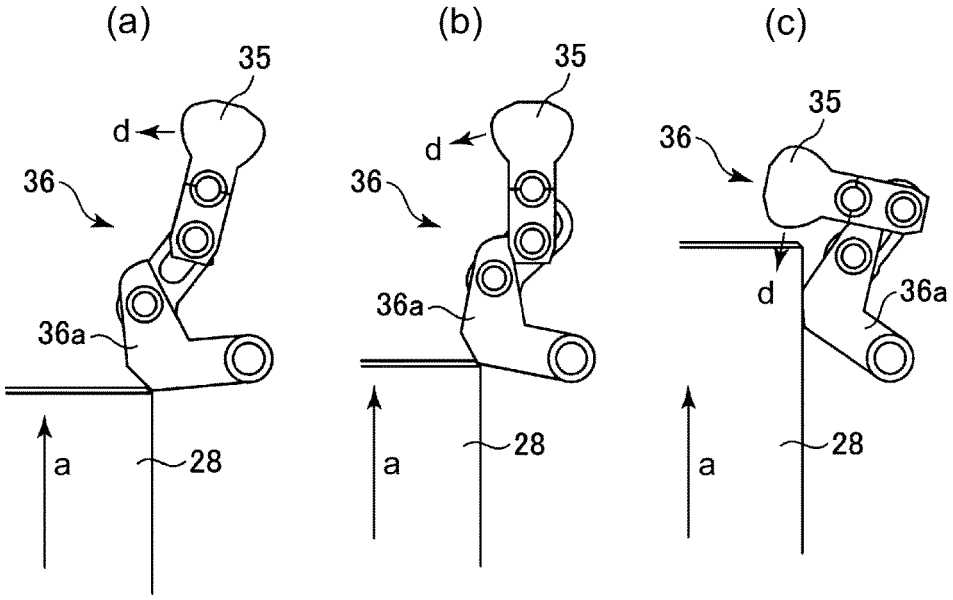

Parts (a), (b) and (c) of FIG. 10 are enlarged views of the cartridge holding mechanism to illustrate the operation of the cartridge holding mechanism.

Figure 11:
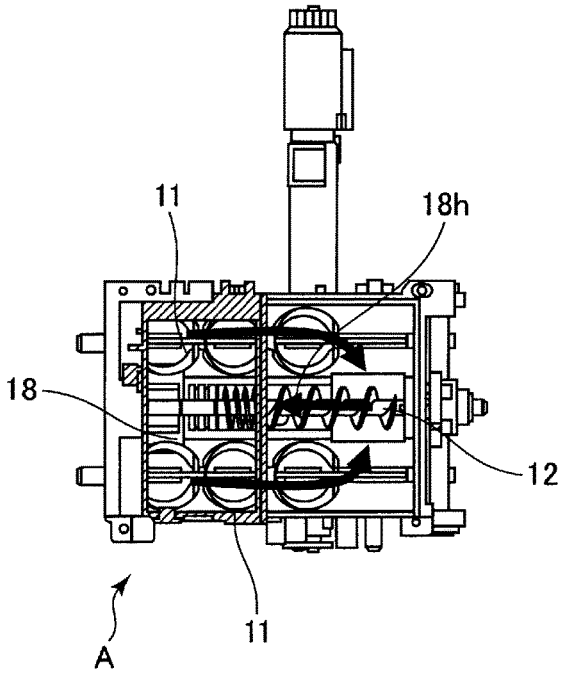

FIG. 11 is a sectional view of the hopper.

Figure 12:
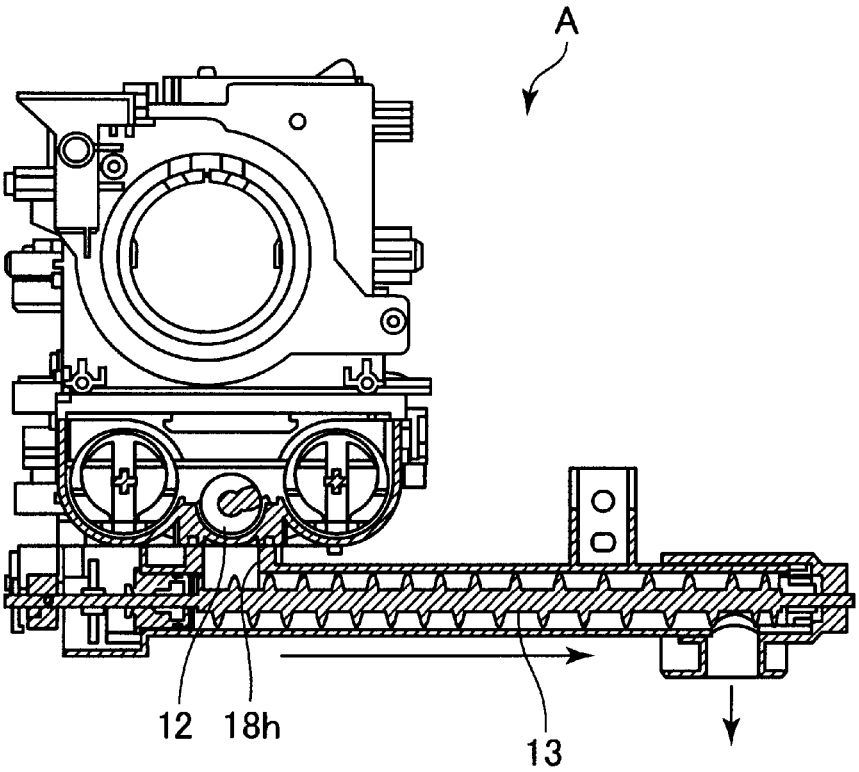

FIG. 12 is a sectional view of the hopper.

Figure 13:
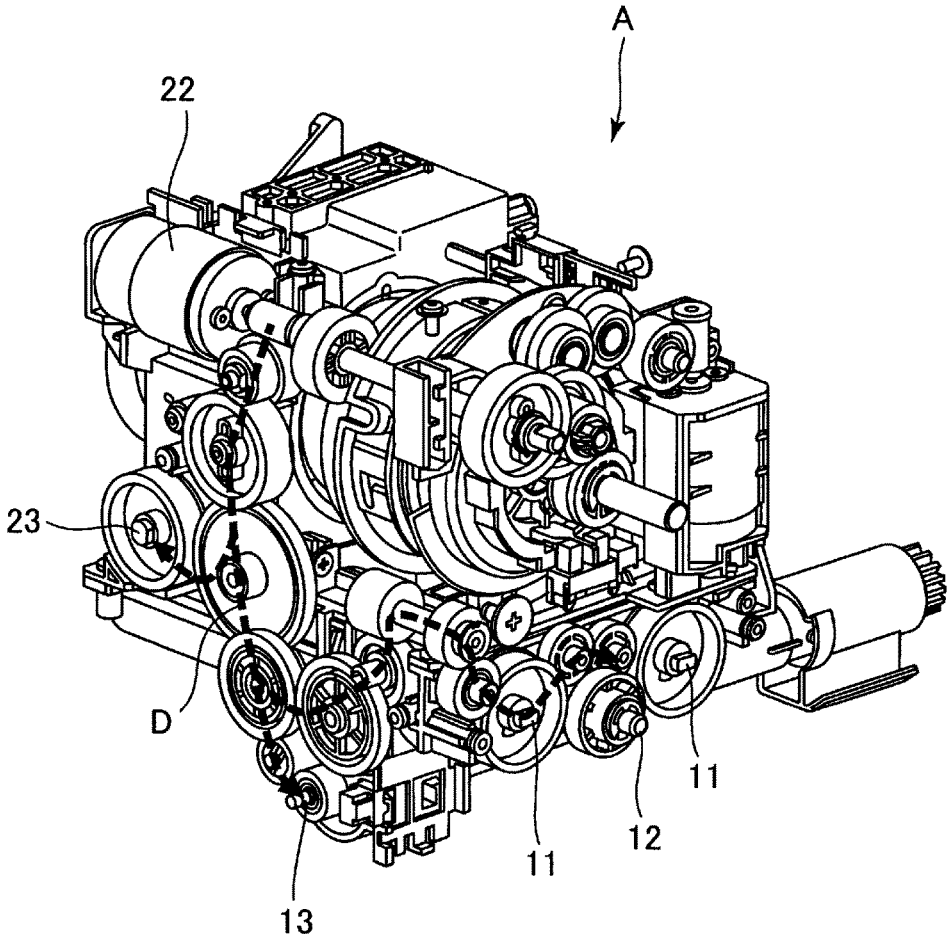

FIG. 13 is a perspective view of the hopper.

It is for describing the toner delivery operation.

Figure 14:
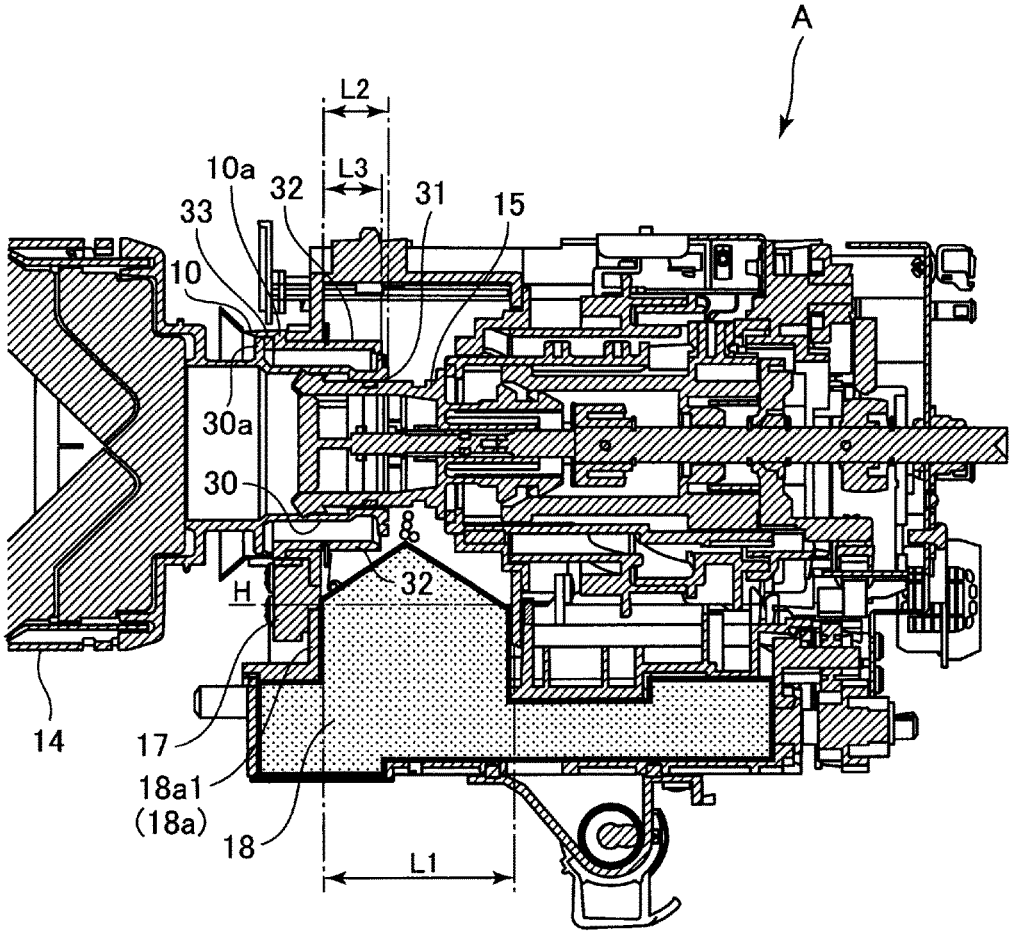

FIG. 14 is a sectional view of the hopper when the toner storage portion of the hopper is full of toner.

Figure 15:
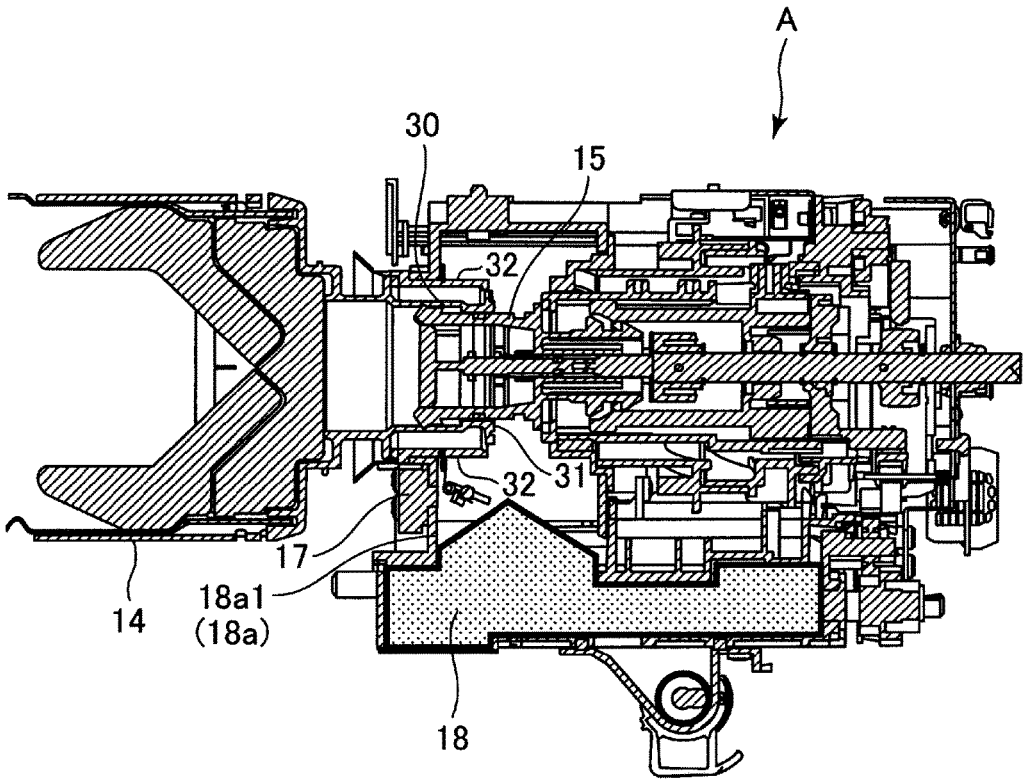

FIG. 15 is a sectional view of the hopper after the consumption of the toner in the toner storage portion of the hopper by a certain amount.

Figure 16:
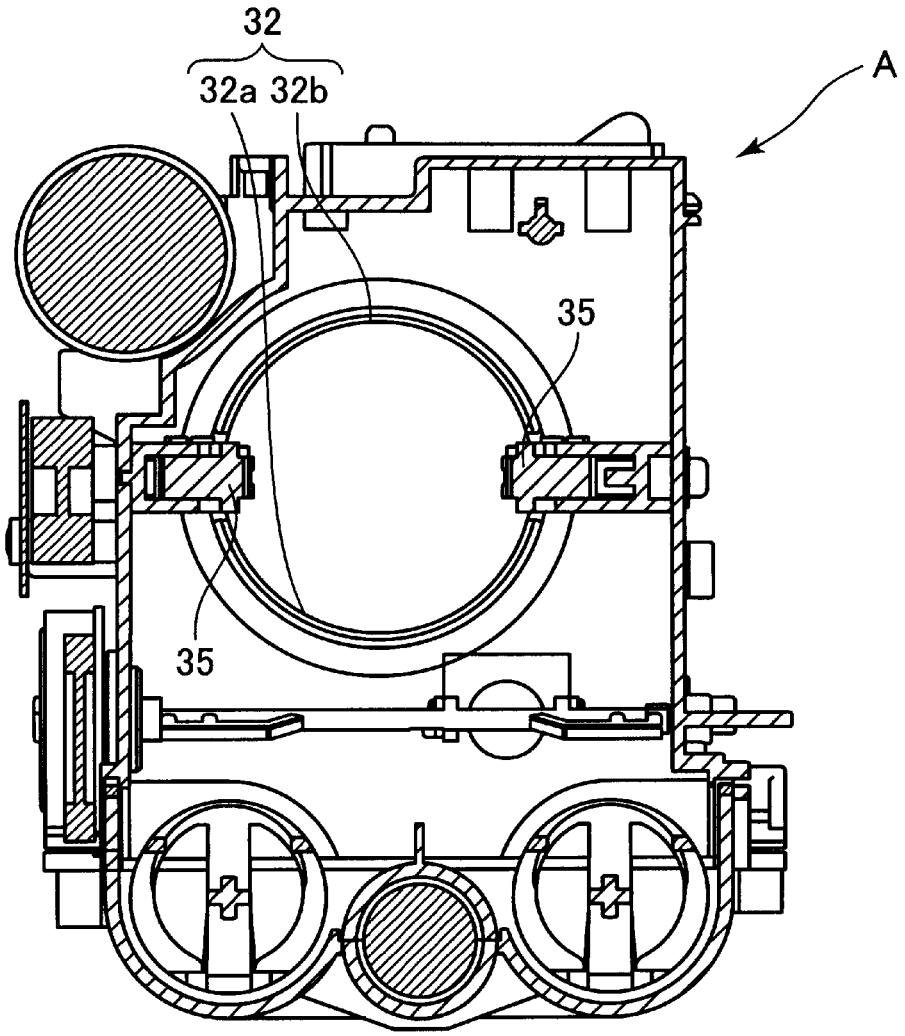

FIG. 16 is a sectional view of the hopper.

Figure 17:
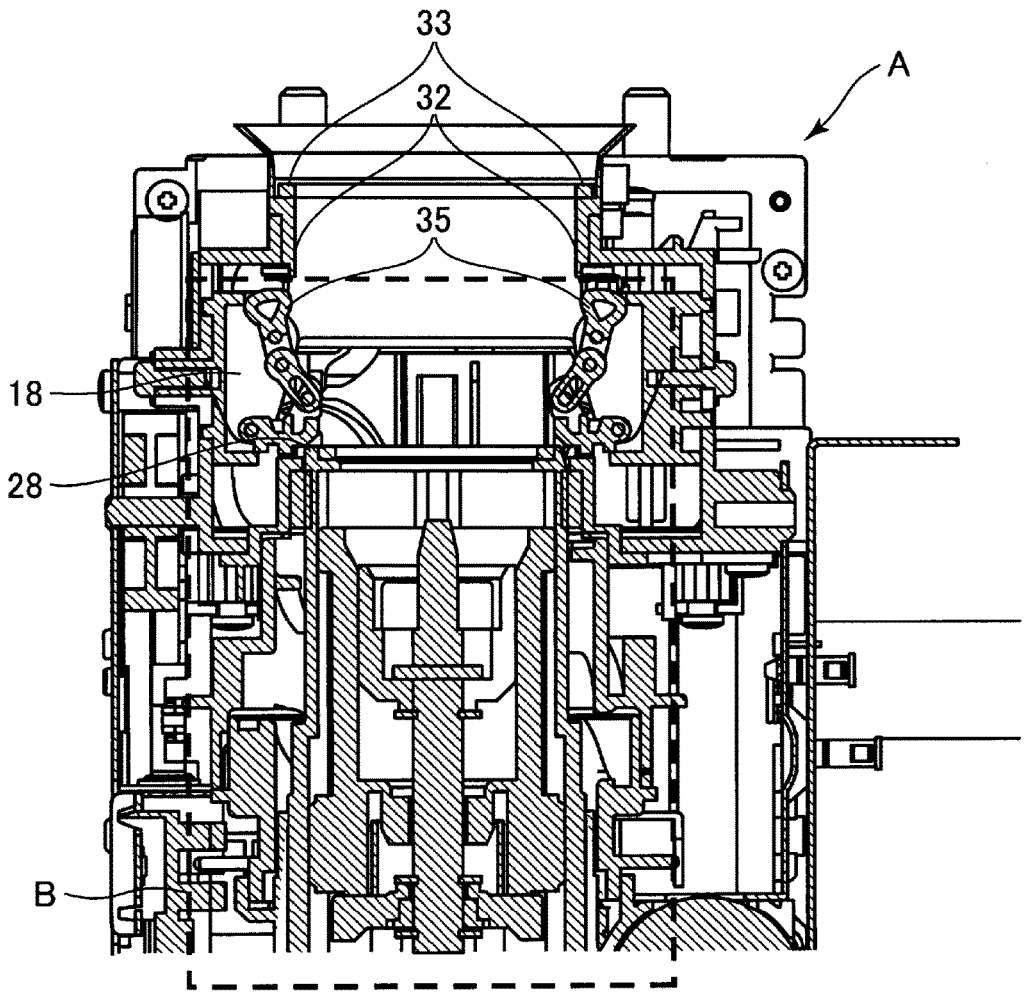

FIG. 17 is a sectional view of the hopper.

Figure 18:
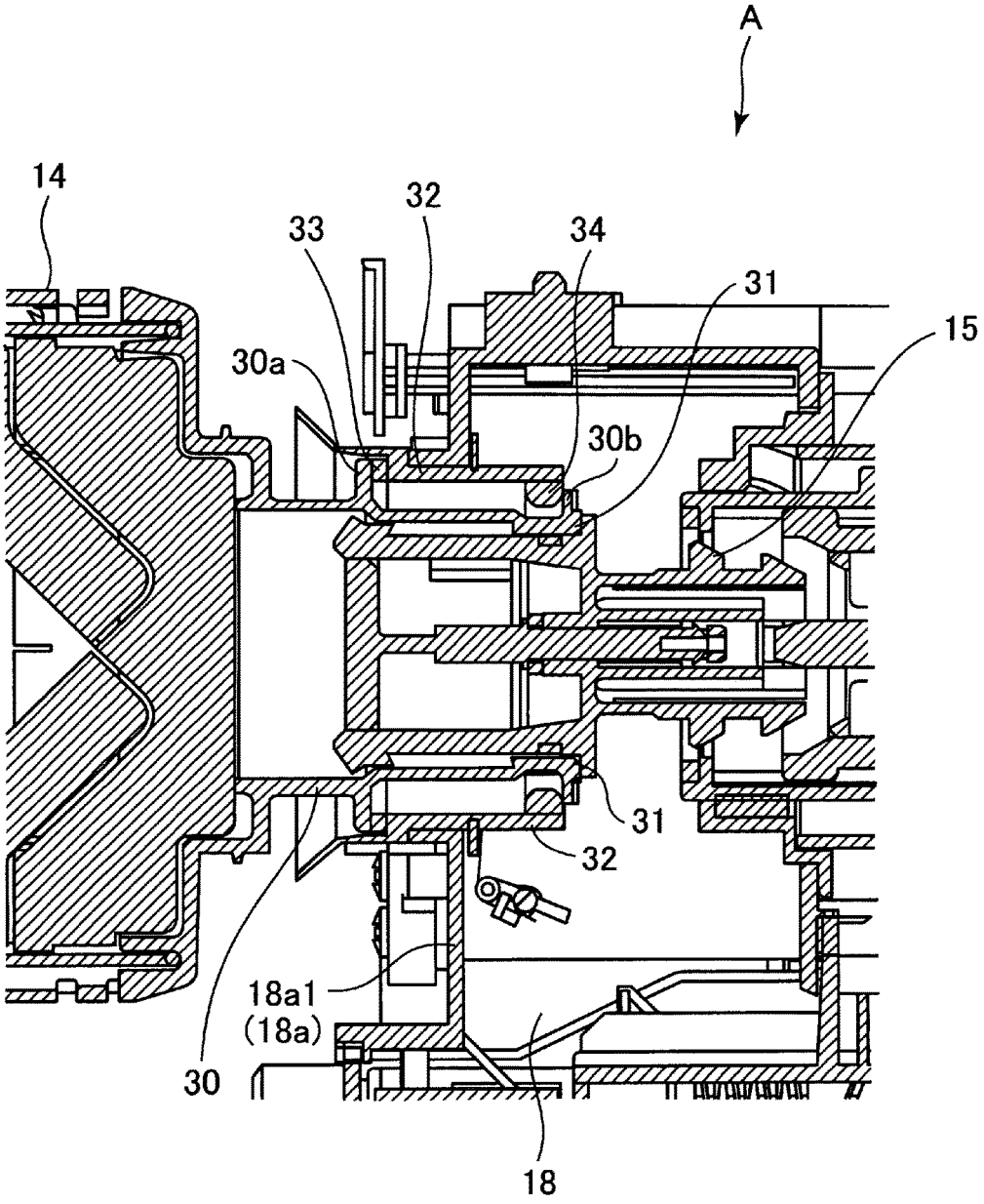

FIG. 18 is a sectional view of one of the other examples of the hopper.

Figure 19:
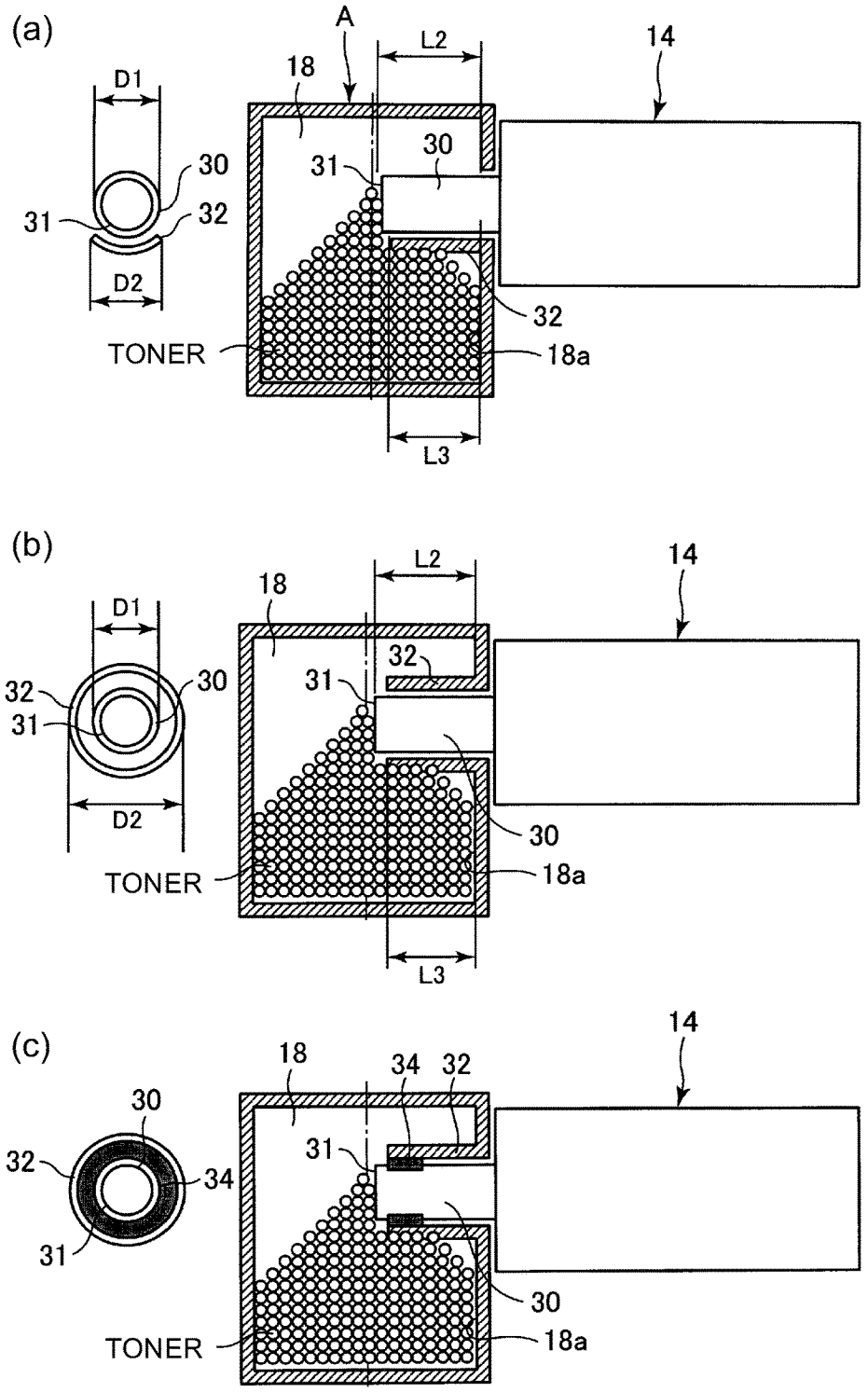

Parts (a), (b) and (c) of FIG. 19 are schematic views of the combination of the toner storage portion and toner cartridge. It is for describing the shielding portion.

Figure 20:
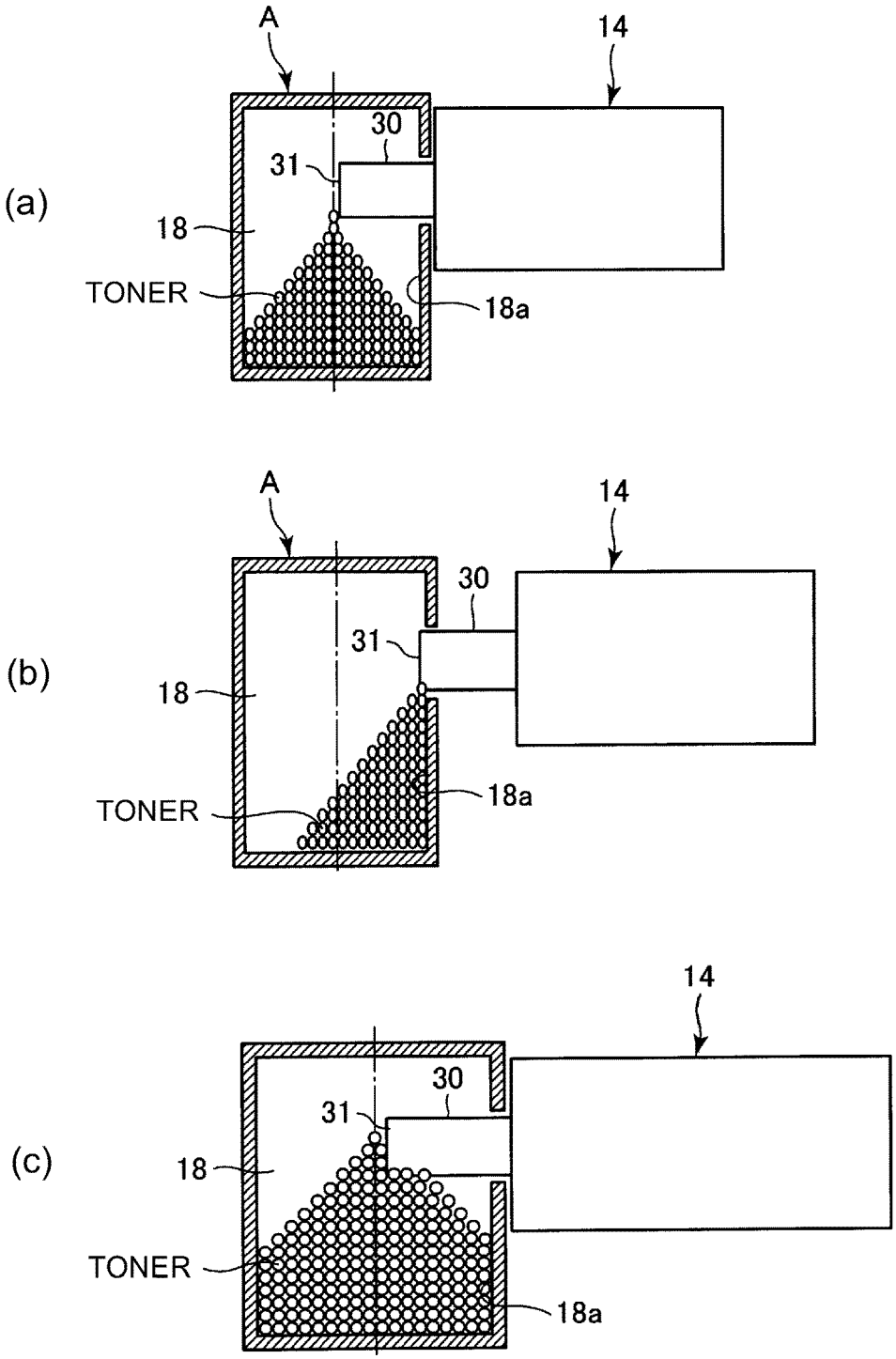

Parts (a), (b) and (c) of FIG. 20 are schematic views of the combination of the hopper and toner cartridge. It is for describing the issue to which the present invention is related.

DESCRIPTION OF THE EMBODIMENTS

Hereinafter, the present invention is described in greater detail with reference to an image forming apparatus in accordance with the present invention, and appended drawings.

[Embodiment 1]

1. Overall Structure and Operation of Image Forming Apparatus

Figure 1:
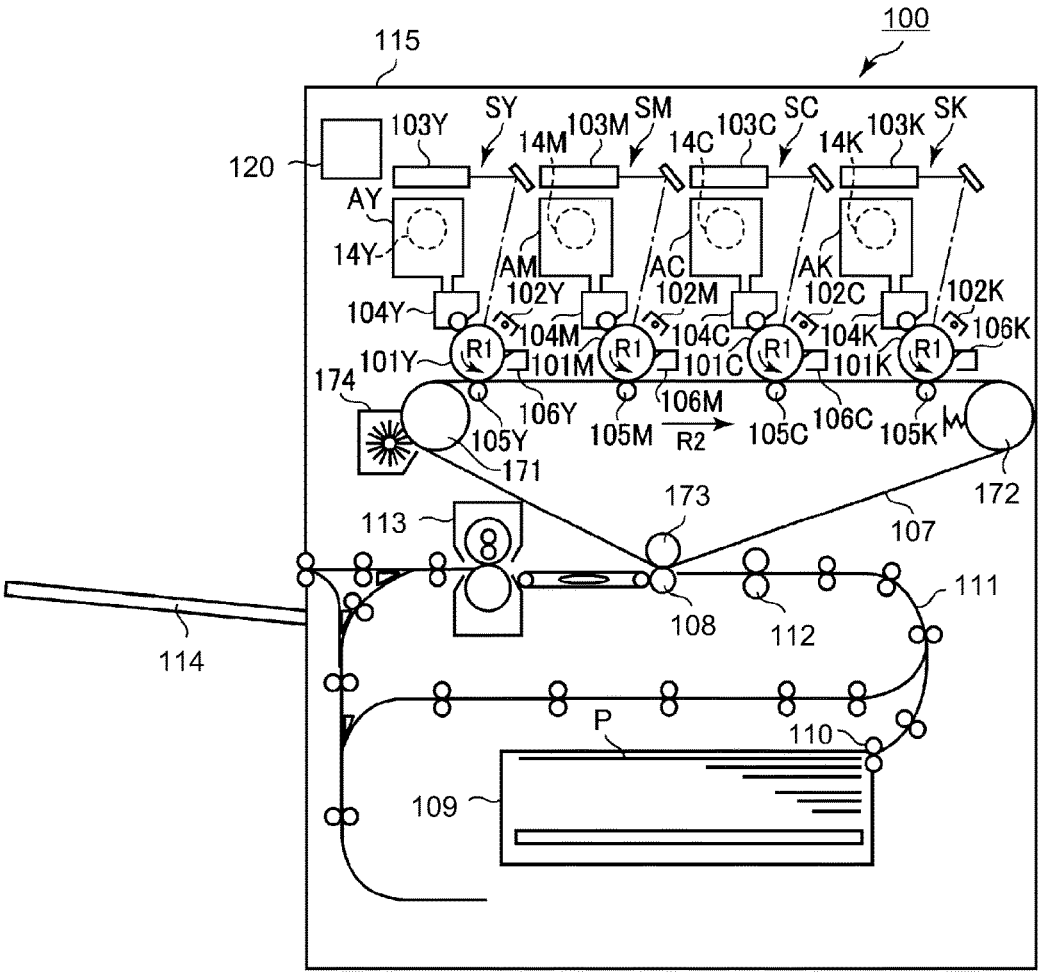
FIG. 1 is a schematic sectional view of a typical electrophotographic image forming apparatus to which the present invention is applicable.

FIG. 1 is a schematic sectional view of the image forming apparatus 100 in this embodiment. The image forming apparatus 100 in this embodiment is a full-color image forming apparatus of the so-called intermediary transfer type, and also, of the so-called tandem type.

The image forming apparatus 100 has the first, second, third, and fourth image forming portions (stations) SY, SM, SC and SK which form yellow, magenta, cyan and black toner images, respectively. The elements in these four image forming portions SY, SM, SC and SK, which are the same or correspondent in function or structure, are sometimes described together, without showing their referential suffixes which are related to their chromatic properties. The image forming portion S has a photosensitive member 101, a charging device 102, an exposing apparatus 103, a developing apparatus 104, a primary transfer roller 105, a photosensitive member cleaning apparatus 106, a developer delivering apparatus A (hopper), a replenishment developer container 14 (toner cartridge), etc., which will be described later.

The photosensitive member 101 (photosensitive drum), as an image bearing member, which is in the form of a drum, is rotationally driven in the direction indicated by an arrow mark R1 in FIG. 1. As the photosensitive member 101 is rotated, its peripheral surface is uniformly charged by the charging device 102. Then, the uniformly charged portion of the peripheral surface of the photosensitive member 101 is scanned by (exposed to) a beam of laser light emitted by the exposing apparatus (laser scanner) while being modulated according to the information of the image to be formed. Consequently, an electrostatic latent image (electrostatic image) is effected on the peripheral surface of the photosensitive member 101. The electrostatic latent image formed on the peripheral surface of the photosensitive member 101 is developed into a visible image with the developer which the developing apparatus 104 uses. That is, a toner image is formed on the photosensitive member 101. In this embodiment, the developer used by the developing apparatus 104 is two-component developer which is a mixture of toner (non-magnetic toner) and carrier (magnetic carrier). The developing apparatus 104 is supplied, with toner, by an amount which is correspondent to the amount by which toner is consumed for the development, by the hopper A. The hopper A is replenished with toner by the toner cartridge 14.

The image forming apparatus 100 is provided with an intermediary transfer belt 107 as an intermediary transferring member which is disposed in such a manner as to oppose the four photosensitive members 101. The intermediary transfer belt 107 is suspended and kept tensioned by a combination of a driving roller 171, a tension roller 172, and a belt-backing roller 173 which opposes a secondary transfer roller. Further, the image forming apparatus 100 is provided with primary transfer rollers 105 as a primary transferring means which are disposed on the inward side of a loop which the intermediary transfer belt 107 forms, in such a manner as to oppose the photosensitive members 101, one for one. The toner image formed on each photosensitive member 101 as described above is electrostatically transferred (primary transfer) onto the intermediary transfer belt 107 by the primary transfer roller 105 to which the primary transfer bias is being applied, while the intermediary transfer belt 107 is circularly rotated in the direction indicated by an arrow mark R2 in FIG. 1, while remaining in contact with each photosensitive member 101. For example, in an operation for forming a full-color image, monochromatic yellow, magenta, cyan and black toner images are formed on the photosensitive members 101, one for one, and are sequentially transferred onto the intermediary transfer belt 107 in such a manner that they are layered upon the intermediary transfer belt 107.

Further, the image forming apparatus 100 is provided with a secondary transfer roller 108 as a secondary transferring means which is disposed on the outward side of the loop which the intermediary transfer belt 107 forms, in such a manner as to oppose the aforementioned belt-backing roller 173. The toner images formed on the intermediary transfer belt 107 as described above are electrostatically transferred (secondary transfer) onto a sheet P of recording medium such as paper, by the secondary transfer roller 108 to which the secondary transfer bias is being applied, while the sheet P is conveyed between the intermediary transfer belt 107 and secondary transfer roller 108, remaining pinched by the belt 107 and roller 108. The sheet P is stored in a cassette 109, and is conveyed into a recording medium passage 111 by a feed roller 110, and then, is conveyed by a pair of registration rollers to the area of contact between the secondary transfer roller 108 and intermediary transfer belt 107, with such timing that it arrives at the area of contact at the same time as the toner images on the intermediary transfer belt 107.

After the transfer of the toner images onto the sheet P of recording medium, the sheet P is conveyed to a thermal fixing apparatus 113 as a fixing means, in which the sheet P and the toner images thereon are heated and pressed, whereby the toner images become fixed to the sheet P (melt and become fixed to sheet P as they cool down). Thereafter, the sheet P is discharged into an external delivery tray 114 with which the main assembly 115 of the image forming apparatus 100 is provided.

On the other hand, the toner (transfer residual toner) remaining on the peripheral surface of the photosensitive member 101 after the primary transfer is removed and recovered by the photosensitive member cleaning apparatus 106 as a cleaning means. Further, the toner (transfer residual toner) remaining on the intermediary transferring member 107 after the secondary transfer is removed from the intermediary transfer belt 107 and recovered, by the belt cleaning apparatus 174 as an intermediary transferring member cleaning means. The belt cleaning apparatus 174 is disposed so that it opposes the driving roller 171.

Figure 2:
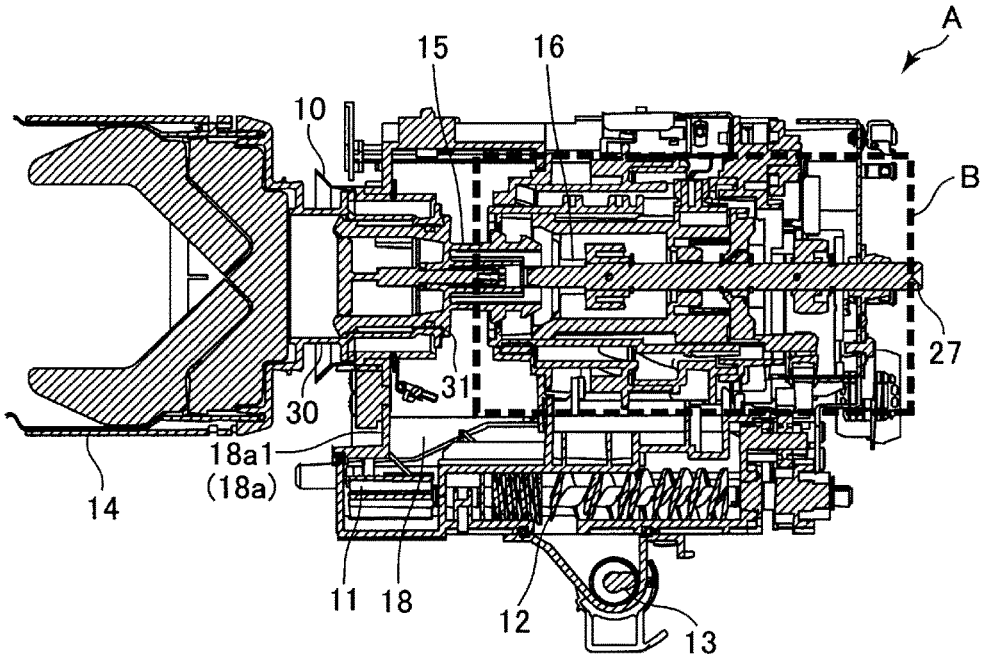
FIG. 2 is a sectional view of one of the hoppers in the image forming apparatus shown in FIG. 1.

2. General Description of Replenishment Developer Container and Developer Delivering Apparatus Next, the general description of the replenishment developer container and developer delivering apparatus is given. FIG. 2 is a sectional view of a combination of the developer delivering apparatus A (hopper) and a part of the replenishment developer container (toner cartridge).

By the way, regarding the orientation of the image forming apparatus 100 and its elements, their front sides coincide with the front side of the sheet of paper on which FIG. 1 is printed, and their rear sides coincide with the back side of the sheet of paper on which FIG. 1 is printed. Further, the left and right sides of the image forming apparatus 100 and its elements means the left and right sides when the image forming apparatus 100 is seen from the front side. Further, their top-bottom (vertical) direction basically coincides with their top-bottom direction (vertical direction), that is, the gravity direction, when the image forming apparatus 100 is in use. However, this do not mean "directly upward" or "directly downward". That is, they include the top or bottom side with reference to the horizontal plane which coincides with a specific point or element of the image forming apparatus 100, which is being described. FIG. 2 is a sectional view of a combination of the hopper A and the toner delivery portion of the toner cartridge as seen from the right side.

The hopper A is attached to the top portion of the developing apparatus 104 which is on the back side of the main assembly 115 (which hereafter will be referred to as "apparatus main assembly 115") of the image forming apparatus 100. The toner cartridge 14 is engaged with the hopper A in such a manner that it can be disengaged from the hopper A. The hopper A supplies the developing apparatus 104 with toner. It is replenished with toner by the toner cartridge 14. The toner cartridge 14 is provided with a toner delivery portion 30, with which one of its lengthwise ends (in terms of direction parallel to its rotational axis) is provided. It is engaged with the hopper A; its toner delivery portion 30 is inserted into the hopper A through the toner reception opening 10 of the hopper A. As the hopper A receives toner from the toner cartridge 14, it stores (temporarily) the toner, and then, delivers the toner to the developing apparatus 104 by conveying the toner with the use of its stirring screw 11, first screw 12, and second screw 13, which are toner conveying members, with which it is provided.

The hopper A has a rotational mechanism B which not only opens or closes a toner delivery opening 31, which is an opening with which the end of the toner delivery portion 30 of the toner cartridge 14 is provided, but also, rotates the toner cartridge 14 to cause the toner cartridge 14 to deliver toner to the hopper A. As the toner cartridge 14 is installed in the apparatus main assembly 115, the cap engaging member 16 of the rotational mechanism B engages with the cap 15, with which the toner outlet 31 of the toner cartridge 14 is remaining sealed. Consequently, not only is the toner outlet 31 opened, but also, it becomes possible for the toner cartridge 14 to be rotated. Thus, as the cap engaging member 16 of the rotational mechanism B is rotated, the toner cartridge 14 is rotated by the cap engaging member 16. Thus, the toner is delivered from the toner cartridge 14 to the hopper A. By the way, in this embodiment, a controlling portion 120 (FIG. 1), with which the apparatus main assembly 115 is provided, integrally controls the operations of the image forming apparatus 100, which includes the operation of the hopper A.

Figure 3:
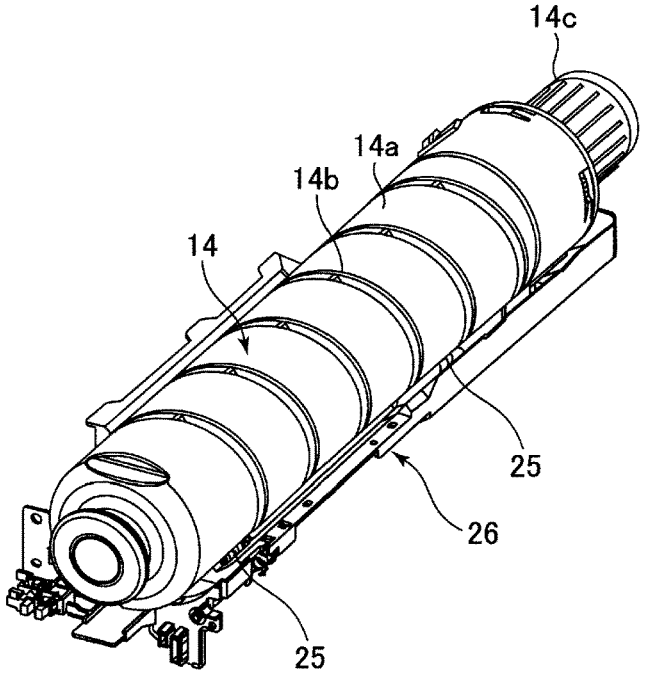
FIG. 3 is a perspective view of a combination of one of the toner cartridges, shown in FIG. 1, and the corresponding cartridge tray.
Figure 4:
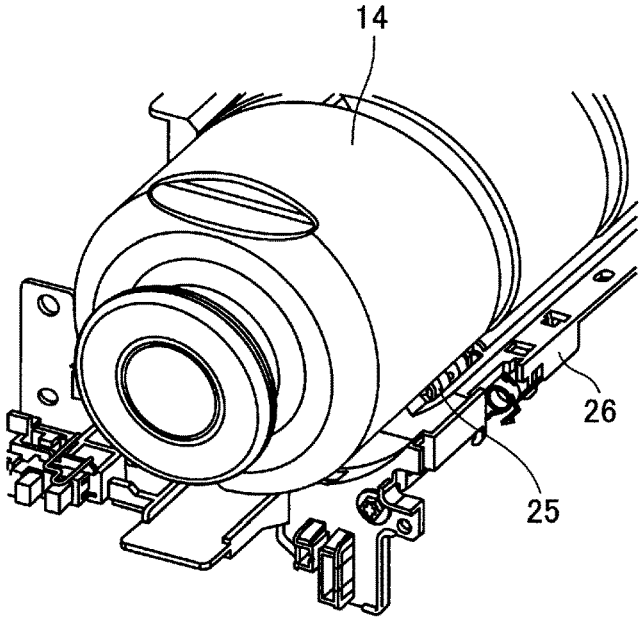
FIG. 4 is a perspective view of the toner delivery end portion of the combination shown in FIG. 3.
Figure 5:
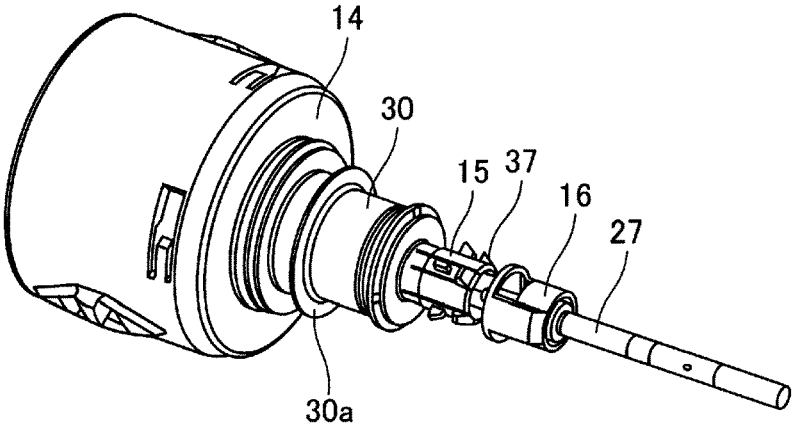
FIG. 5 is a perspective view of a joint between the toner cartridge and cap engaging member, and its adjacencies.

3. Installation and Uninstallation of Toner Cartridge, and Toner Delivery to Hopper Next, the installation and uninstallation of the toner cartridge 14, and the toner delivery from the toner cartridge 14 to the hopper A, are described. FIG. 3 is a perspective view of the toner cartridge 14 as seen from the front side of the apparatus main assembly 115. FIG. 4 is a perspective view of the front end portion of the toner cartridge 14, and its adjacencies, as seen from the front side of the toner cartridge 14. FIG. 5 is a perspective view of the rear end portion of the toner cartridge 14, and its adjacencies, as seen from the rear side of the toner cartridge 14.

Referring to FIG. 3, the toner cartridge 14 has a roughly cylindrical storage portion 14*a*, in which the toner to be delivered to the hopper A is stored. It has also a spiral conveying portion 14*b*, which inwardly protrudes from the cylindrical wall of the storage portion 14*a*. As the toner cartridge 14 is driven by the rotational mechanism B, the toner stored in the toner cartridge 14 is conveyed in the front-to-rear direction. The rear end portion of the toner cartridge 14 is provided with a roughly cylindrical toner delivery portion 30, the tip of which is provided with the toner outlet 31 (FIG. 8) through which the toner is discharged. The cylindrical toner delivery portion 30 is protrusive in the direction (lengthwise direction of toner cartridge 14) parallel to the rotational axis of the toner cartridge 14. The toner in the toner cartridge 14 is conveyed to the toner outlet 31 of the toner delivery portion 30, and then, is discharged into the hopper A through the toner outlet 31, to be delivered into the storing portion 18 (FIG. 2) of the hopper A. By the way, in FIG. 3, the toner delivery portion 30 of the toner cartridge 14 is covered with a cover 14*c*, which is to be removed before the toner cartridge 14 is installed in the apparatus main assembly 115.

Referring to FIGS. 3 and 4, the toner cartridge 14 is to be installed into the apparatus main assembly 115 so that as it is installed, it will be placed on a cartridge tray 26, with which the apparatus main assembly 115 is provided, and which is provided with rollers 25 so that the toner cartridge 14 is enabled to smoothly rotate. Until the cap 15 is removed by the operation carried out by the rotational mechanism B to open the toner outlet 31 of the toner cartridge 14, the toner outlet 31 remains sealed with the cap 15. That is, the toner cartridge 14 is structured so that the toner outlet 31 cannot be easily opened by an operator such as a user, a service personal, or the like. The toner cartridge 14 is inserted into the apparatus main assembly 115 from the front side of the apparatus main assembly 115 in the front-to-rear direction, in the direction parallel to its rotational axis. Referring to FIG. 5, at the beginning of the insertion of the toner cartridge 14 into the apparatus main assembly 115, the cap 15 of the toner cartridge 14 is not in engagement with the cap engaging member 16 of the rotational mechanism B. As the toner cartridge 14 is inserted deeper into the apparatus main assembly 115, and it is detected that the toner cartridge 14 has just been properly installed in the apparatus main assembly 115, the rotational mechanism B begins to be driven to remove the cap 15. By the way, whether or not the toner cartridge 14 has just been properly installed in the apparatus main assembly 115 is detected by the controlling portion 120 with the use of a sensor (unshown) with which the apparatus main assembly 115 is provided to detect whether or not the toner cartridge 14 is in a preset position on the cartridge tray 26.

Figure 6:
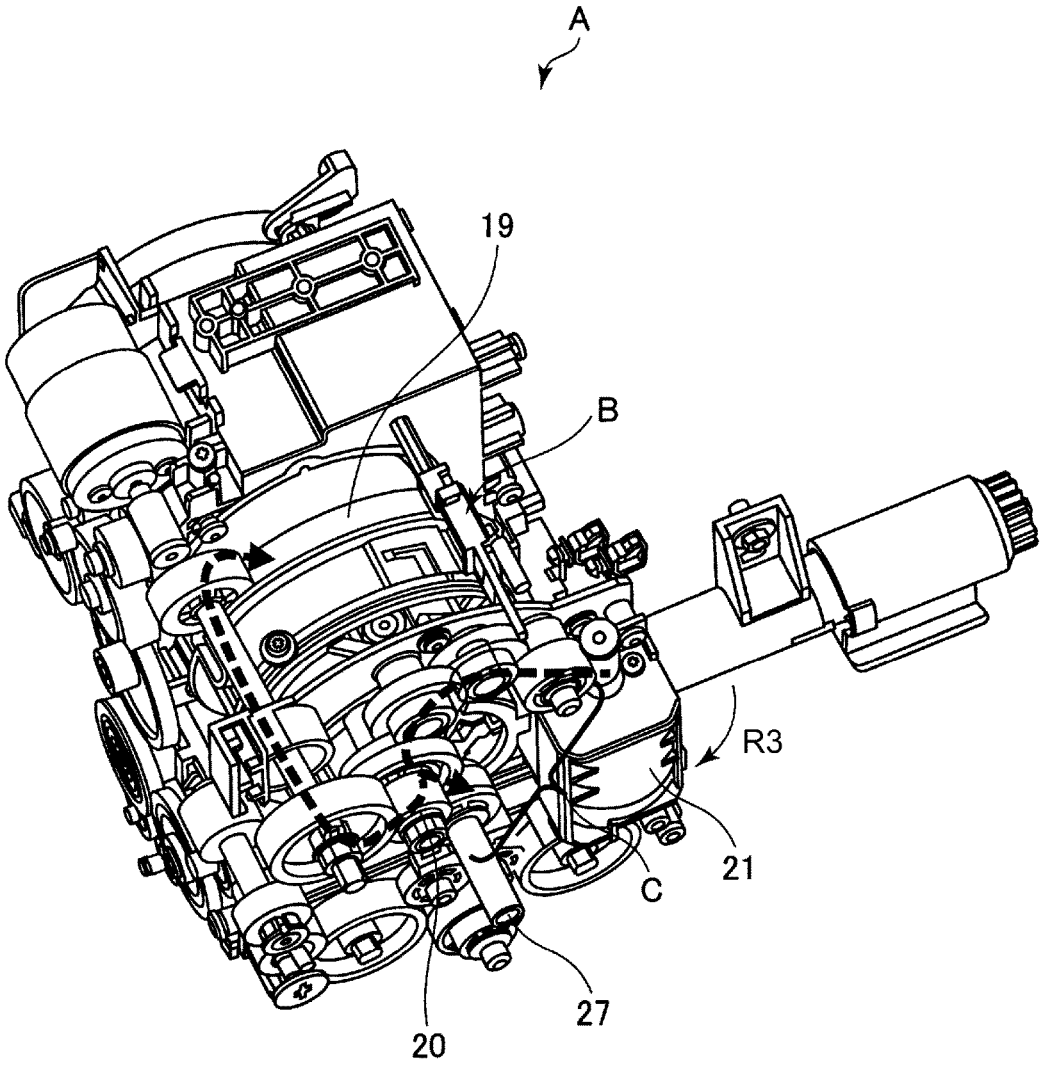
FIG. 6 is a perspective view of the hopper. It is for showing the structure of the rotational mechanism for opening or closing the toner cartridge.

FIG. 6 is a perspective view of the hopper A as seen from its rear side. It is for showing structure of the rotational mechanism B. The rotational mechanism B is driven by the first motor 21 as a driving force source. The cap 15 is opened or closed by the rotation of the first motor 21, as the motor 21 is rotated in the positive (clockwise) direction indicated by an arrow mark R3 in FIG. 6. As the first motor 21 is positively rotated, the driving force from the motor 21 is transmitted to a cam gear 19 by the gears of the drive train C to drive the rotational mechanism B.

Figure 7:
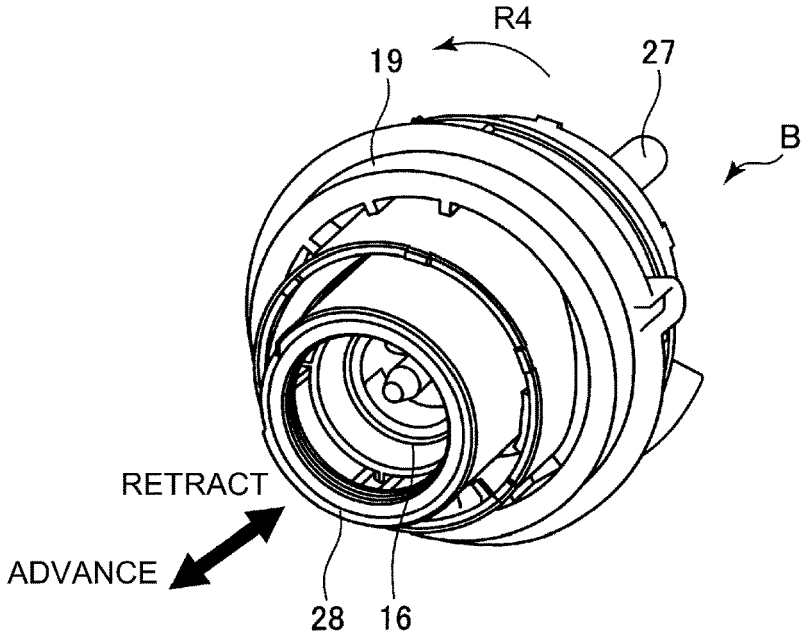
FIG. 7 is a perspective view of the points of engagement between the rotational mechanism B and cap, and their adjacencies.

FIG. 7 is a perspective view of the cam gear 19 of the rotational mechanism B and its adjacencies, as seen from the front side of the rotational mechanism B. As the first motor 21 positively rotates, the cam gear 19 is rotated in the direction (counterclockwise direction) indicated by an arrow mark R4 in FIG. 7. The inward surface of the cam gear 19, in terms of the radius direction of the cam gear 19, is provided with a groove (unshown). Further, the rotational mechanism B is provided with a cylindrical member 28 having a protrusion (unshown) which engages in the aforementioned groove of the cam gear 19. The cylindrical member 28 is disposed so that it occupies the center portion of the cam gear 19 in terms of the radius direction of the gear 19. Thus, as the cam gear 19 rotationally moves, the cylindrical member 28 moves frontward or backward (reciprocally moves) in the direction parallel to the rotational axis of the cam gear 19. More specifically, as the cam gear 19 rotates in the direction indicated by the arrow mark R4 in FIG. 7, the cylindrical member 28 moves forward, causing the cap engaging member 16, which is on the inward side of the cylindrical member 28 in terms of the radius direction of the cylindrical member 28, to move frontward. Thus, an engagement protrusion 37 (FIG. 5) with which the cap 15 is provided, snaps into the cap engaging member 16. Then, as the cam gear 19 rotates further in the direction indicated by the arrow mark R4 in FIG. 7, the cylindrical member 28 begins to move backward, causing thereby the cap engaging member 16 to move backward. Consequently, the cap 15 is pulled out of the toner outlet 31.

Figure 8:
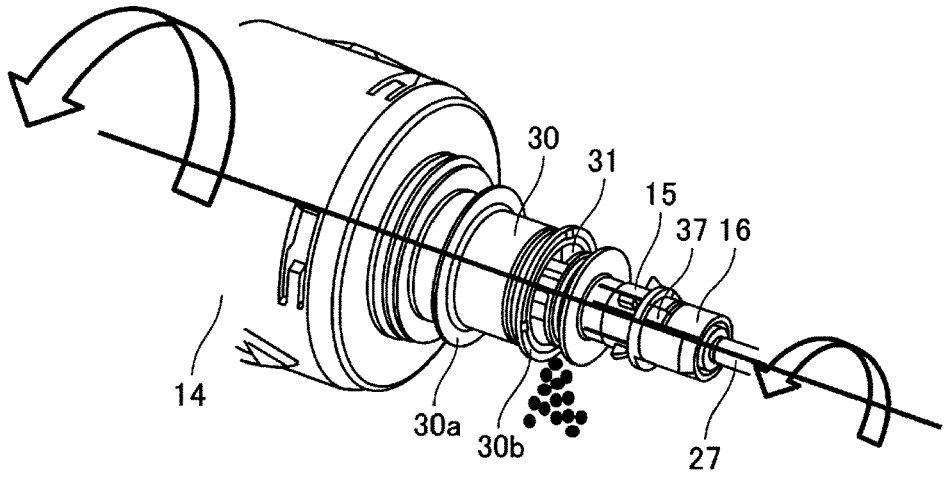
FIG. 8 is a perspective view of the joint between the toner cartridge and cap engaging member, and its adjacencies.

FIG. 8 is a perspective view of the toner delivery portion 30 of the toner cartridge 14, and its adjacencies, after the pulling out of the cap 15 from the toner outlet 31. When the toner cartridge 14 is in the state shown in FIG. 8, not only is the cap 15 in engagement with the cap engaging member 16, but also, the toner delivery portion 30 of the toner cartridge 14 (FIG. 14). That is, the cap 15 is attached to the toner delivery portion 30 in such a manner that when the toner cartridge 14 is in the state in which it can transfer the driving force in the rotational direction of the toner cartridge 14, it allows the toner cartridge 14 to slide in the direction parallel to the axial line of the toner cartridge 14.

On the other hand, the toner cartridge 14 is rotated by rotation of the first motor 21 in the opposite direction from the direction indicated by the arrow mark R3 in FIG. 6. More specifically, as the first motor 21 reversely rotates, the driving force from the motor 21 is split by a one-way gear 14, so that a part of it is transmitted to a cartridge driving shaft 27, which is an integral part of the cap engaging member 16. Thus, as the cartridge driving shaft 27 rotates, the cap engaging member 16 also rotates. As the cap engaging member 16 rotates, the cap 15 which is in engagement with the cap engaging member 16 rotates, causing the toner cartridge 14 to rotate. Thus, the toner in the toner cartridge 14 is discharged from the toner cartridge 14 through the toner outlet 31 of the toner cartridge 14 to be delivered into the hopper A.

Next, referring to FIGS. 9 and 10, the operation for opening the cap 15 and the operation for closing the cap 15 are described further. FIG. 9 is a sectional view of the joint between the toner cartridge 14 and hopper A, and its adjacencies, at a horizontal plane, as seen from the top side of the joint. FIG. 10 is an enlarged view of the cartridge holding mechanism 36, which will be described later. It is for describing the action of the mechanism 36 in greater detail.

Part (a) of FIG. 9 shows the state of a combination of the toner cartridge 14 and hopper A when the toner cartridge 14 begins to engage with the hopper A. When the toner cartridge 14 is in the position shown in part (a) of FIG. 9, it can be inserted into, or moved away from, the apparatus main assembly 115 by an operator. The hopper A is provided with a cartridge holding mechanism 36 which holds the toner cartridge 14 when the toner cartridge 14 is engaged with the hopper A. The cartridge holding mechanism 36 is a linking mechanism having a cartridge holding member 35 and a linking member **36*a* for causing the cartridge holding member 35 to grasp or release the toner cartridge 14. The cartridge holding mechanism 36 is attached to the inward surface of the hopper A. When the combination is in the state shown in part (a) of FIG. 9, it is in a position (part (a) of FIG. 10) into which it is retracted from a position (shown in part (c) of FIG. 9) in which it holds the toner cartridge 14**.

Part (b) of FIG. 9 shows the state of the combination when the cap engaging member 16 began to be moved in the direction indicated by an arrow mark a in part (a) of FIG. 9 to be engaged with the engagement protrusion 37 of the cap 15. As the cap engaging member 16 is moved in the direction indicated by the arrow mark a, the cylindrical member 28 is moved with the cap engaging member 16 in the direction indicated by the arrow mark a in part (b) of FIG. 9, and pushes up a linking member **36*a*. Further, the cartridge holding member 35, which moves with the linking member 36*a*, begins to be rotated in the direction indicated by an arrow mark d in part (b) of FIG. 9, by the movement of the linking member 36*a* (part (b) of FIG. 10**).

Part (c) of FIG. 9 shows the state of the aforementioned combination of the toner cartridge 14 and hopper A immediately before the engagement protrusion 37 of the cap 15 begins to engage with the cap engaging member 16. As the cylindrical member 28 is sufficiently moved in the direction indicated by the arrow mark a shown in part (c) of FIG. 9, the linking member 36*a* is moved to a preset position, causing thereby the cartridge holding member 35 to move into a position in which it holds the toner cartridge 14. In this embodiment, the cartridge holding member 35 holds the toner cartridge 14 by coming into contact with a holdable portion 30*b* (by which toner cartridge 14 is held) which protrudes outward, in terms of the radius direction of the toner delivery portion 30, from the edge of the toner outlet 31. As the cartridge holding member 35 comes into contact with the holdable portion 30*b* of the toner delivery portion 30, the linking member 36*a* is supported by the peripheral surface of the cylindrical member 28, becoming thereby fixed in position. Thus, the cartridge holding member 35 is immovably held in a preset position (part (c) of FIG. 10). When the protrusion 37 of the cap 15 is in engagement with the cap engaging member 16, the cartridge holding member 35 is enabled to hold the toner cartridge 14 in the position shown in part (c) of FIG. 9, against the force which acts on the toner cartridge 14 in the direction indicated by the arrow mark a, when the protrusion 37 of the cap 15 engages with the cap engaging member 16. This positional relationship is established by the time when the protrusion 37 of the cap 15 becomes engaged with the cap engaging member 16.

Part (d) of FIG. 9 shows the state of the combination of the hopper A and toner cartridge 14 after the protrusion 37 of the cap 15 became engaged with the cap engaging member 16, and the cap engaging member 16 retracted in the direction indicated by an arrow mark b in part (d) of FIG. 9. As the cap 15 is pulled out of the toner cartridge 14, the toner outlet 31 of the toner cartridge 14 is exposed (FIG. 8). The linking member 36*a* remains pressed by a spring (unshown), as a pressing means, toward the position indicated in part (a) of FIG. 9. Thus, as the cylindrical member 28 retracts with the cap engaging member 16, the linking member 36*a* loses its support, and therefore, returns to the position shown in part (a) of FIG. 9. Thus, the cartridge holding member 35 retracts from its cartridge holding position, returning thereby into the position shown in part (a) of FIG. 9. When the combination is in the state shown in part (d) of FIG. 9, the toner cartridge 14 begins to deliver toner by being rotated in its circumferential direction. At this point in time, the cartridge holding member 35 will have retracted. Therefore, it does not occur that the toner cartridge 14 and cartridge holding member 35 rub against each other.

By the way, when the toner outlet 31 is sealed by the cap 15, the action of a releasing member (unshown) occurs in addition to the above-described actions. The action of each member, which occurs when the toner outlet 31 is sealed is roughly opposite in order, that is, from the state shown in part (d) of FIG. 9 to the state shown in part (a) of FIG. 9. The cap 15 is pressed into the toner outlet 31 when the cartridge holding member 35 is in the cartridge holding position shown in part (c) of FIG. 9. By the way, the abovementioned releasing member is such a member that presses the engagement protrusion of the cap 15 inward of the cap 15 in terms of the radius direction of the cap 15 to disengage the cap 15 from the cap engaging member 16.

In this embodiment, the cartridge holding member 35 operates by receiving driving force from the operation of the cap engaging member 16. Thus, the image forming apparatus 100 in this embodiment is more meritorious in terms of cost than an electrophotographic image forming apparatus provided with a mechanism dedicated to operate the cartridge holding member 35. Further, in this embodiment, the hopper A is provided with both the cap engaging member 16 and cartridge holding member 35. Thus, when the engagement protrusion 37 of the cap 15 is in engagement with the cap engaging member 16, the force which the cap engaging member 16 gives to the toner cartridge 14 and the force which the cartridge holding member 35 is required to support the toner cartridge 14 cancel each other, reducing thereby the amount of load to which elements of the image forming apparatus 100 other than the hopper A is subjected.

4. Toner Delivery to Developing Apparatus from Hopper

Next, the toner delivery to the developing apparatus 104 from the hopper A is described. FIG. 11 is a sectional view of the hopper at a horizontal plane, as seen from the top side of the hopper. The top side of FIG. 11 coincides with the left side of the image forming apparatus 100, and the bottom side of FIG. 11 coincides with the left side of the image forming apparatus 100. FIG. 12 is a sectional view of the hopper A at a vertical plane which coincides with the axial line of the toner outlet 31, as seen from the rear side of the hopper A.

As the control portion 120 determines, based on the output from the sensor (unshown) disposed in the developing apparatus 104, that the developing apparatus 104 is running short of the toner therein, it sends a signal to the hopper A so that the developing apparatus 104 is supplied with an optimal amount of toner. The hopper A is driven in response to this signal sent from the control portion 120 to deliver toner to the developing apparatus 104.

Referring to FIG. 11, the toner stored in the storage portion 18 of the hopper A is conveyed in the front-to-rear direction indicated by an arrow mark in FIG. 11 by a pair of stirring screws 11 disposed on the left and right sides, one for one. Then, as the toner reaches the rear end of the hopper A, it is conveyed to roughly the center portion of the hopper A in the rear-to-front direction indicated by an arrow mark in FIG. 11, by the first screw 12 disposed roughly in the center portion of the hopper A in terms of the left-right direction. The stirring screws 11 are shaped so that while the toner is conveyed by the stirring screws 11, the stirring screws 11 continuously stir the toner to cause the toner to naturally flow, in order to prevent such a problem that the hopper A is clogged with the toner. Referring to FIG. 12, as the toner is conveyed to roughly the center of the hopper A, it is made to fall by gravity through a toner delivery hole 18*h*, which is an opening, with which the bottom wall of the hopper A is provided. Then, it is conveyed to the second screw 13. Then, it is conveyed by the second screw 13 to the developing apparatus 104, or the final destination.

FIG. 13 is a perspective view of the hopper A as seen from the rear side of the hopper A. It is for showing the overall structure of the hopper driving mechanism. As the signal which indicates that the developing apparatus 104 needs to be replenished with toner is sent to the hopper A, the second motor 22, as a driving force source, is driven. The rotational driving force from the second motor 22 is transmitted to the stirring screws 11, first screw 12, and second screw 13 by the gears of the drive train D. Thus, the stirring screw 11, first screw 12, and second screw 13 rotate. Thus, the toner is delivered from the hopper A to the developing apparatus 104.

5. Storage Portion

Next, the storage portion 18 of the hopper A is described. FIG. 14 is a sectional view of the hopper A, as seen from the right side of the hopper A, when the storage portion 18 of the hopper A is virtually filled up with toner. FIG. 15 is a sectional view of the hopper A, as seen from the right side of the hopper A, after the consumption of the toner in the storage portion 18 by a certain amount.

Referring to FIG. 14, the toner cartridge 14 is connected to the hopper A in such a manner that the toner delivery portion 30, with which one of the lengthwise ends (in terms of direction parallel to rotational axis of toner cartridge 14) of the toner cartridge 14 is provided, is inserted into the hopper A through the toner reception opening 10 of the hopper A. In this embodiment, the toner delivery portion 30 is cylindrical, and extends in the direction in which it is inserted into the storage portion 18. Its downstream end, in terms of the direction in which it is inserted into the storage portion 18, has the toner outlet 31. The toner in the toner cartridge 14 is made by gravity to fall from the toner outlet 31, which is the downstream end of the toner delivery portion 30, into the storage portion 18; the toner in the toner cartridge 14 is delivered to the storage portion 18 through the toner outlet 31.

The storage portion 18 is provided with a toner sensor 17 as a detecting portion for detecting the toner in the storage portion 18. More specifically, the sensor 17 detects the position of the upwardly facing surface of the body of toner in the storage portion 18. The toner sensor 17 is attached to the inward surface 18*a* of the storage portion 18, along which the area of contact between the upwardly facing surface of the body of the toner in the storage portion 18 and the inward surface 18*a* rises as the toner is delivered into the storage portion 18. In particular, in this embodiment, it is attached to the inward surface 18*a*1 of the front wall of the storage portion 18.

Referring to FIG. 14, if toner is on the surface of the toner sensor 17, the toner sensor 17 senses the pressure from the toner, and determines that there is a preset amount of toner in the storage portion 18. On the other hand, as toner is delivered to the developing apparatus 104 from the hopper A, the storage portion 18 reduces in the amount of the toner therein. Referring to FIG. 15, if no toner is on the surface of the toner sensor 17, the toner sensor 17 determines that there is not a sufficient amount of toner in the storage portion 18. Then, the hopper A causes the toner cartridge 14 to deliver toner into its storage portion 18 until the surface of the toner sensor 17 is covered with the toner, that is, until it becomes possible for the toner sensor 17 to detect the position of the upwardly facing surface of the body of toner in the storage portion 18.

By the way, the hopper A is provided with a seal 33 for keeping sealed the joint between the hopper A and toner cartridge 14 to prevent the toner from scattering outward from the joint. The seal 33 is disposed so that it is sandwiched between the stair-stepped portion 10*a* formed in the toner delivery opening 10, and the rearwardly facing surface of the flange portion 30*a* with which the toner delivery portion 30 of the toner cartridge 14 is provided.

As the toner is delivered from the toner cartridge 14 into the storage portion 18, it does not flatly accumulate in the storage portion 18. Instead, it accumulates roughly in the form of a cone, the angle of the side wall of which is equal to the angle of repose of toner. From the standpoint of increasing the image forming apparatus 100 in the length of "continuous run" while keeping the hopper A as small as possible, it is desired to increase the storage portion 18 in the ratio between the size of the internal space of the storage portion 18 and the amount by which the storage portion 18 can be naturally filled with toner. In order to fill the storage portion 18 with as much toner as possible, it is more effective to discharge toner to the adjacencies of the center of the storage portion 18 as shown in part (a) of FIG. 20 than to the adjacencies of the inward surface 18*a* of the storage portion 18 as shown in Figure (b). Further, in this embodiment, the toner sensor 17 for detecting the upwardly facing surface of the body of toner in the storage portion 18 is disposed on the inward surface 18*a* of the storage portion 18. By the way, as the toner is delivered into the center portion of the storage portion 18, it accumulates roughly in the form of a cone, the bottom surface of which coincides with the point of the upwardly facing surface of the body of toner in the storage portion 18, and the inward surface 18*a* of the storage portion 18, which is detected by the toner sensor 17. Therefore, from the standpoint of increasing the storage portion 18 in the amount by which toner is allowed to naturally accumulate, it is desired that the toner is discharged to roughly the center of the storage portion 18 with reference to a horizontal plane which coincides the toner sensor 17.

In this embodiment, the image forming apparatus 100 and the toner cartridge 14 therefor are structured so that when the toner cartridge 14 is installed into the apparatus main assembly 115, it is to be inserted into the apparatus main assembly 115 in such an attitude that the toner delivery portion 30 enters the storage portion 18 in the direction which is inter-sectional (roughly perpendicular, in this embodiment) to the gravity direction to be engaged with the hopper A. That is, in terms of the gravity direction, they are structured so that after the installation of the toner cartridge 14 into the apparatus main assembly 115, the toner outlet 31 will be within the space surrounded by the inward surface 18*a* of the storage portion 18, along which the point of contact between the upwardly facing surface of the body of toner in the storage portion 18 and the inward surface 18*a* rises, as the toner is delivered into the storage portion 18 from the toner cartridge 14 (part (d) of FIG. 9). In particular, in this embodiment, the image forming apparatus 100 and the toner cartridge 14 therefor are structured so that after the proper installation of the toner cartridge 14 into the apparatus main assembly 115, the toner outlet 31 will be roughly in the center of the storage portion 18, with reference to a sectional view of the storage portion 18, at a horizontal plane which coincides with the detection point of the toner sensor 17. Here, "approximate center" includes the points which are deviant by up to approximately 20% from the dead center of the storage portion 18, in addition to the absolute center, in terms of the horizontal direction (leftward, rightward, frontward, and rearward), in addition to the dead center.

To describe further, referring to FIG. 14, it is assumed here that with reference to a horizontal plane H, which coincides with the toner sensor 17, the width (distance between opposing two inward surfaces) of the storage portion 18, in terms of the direction in which the toner delivery portion 30 is inserted into the storage portion 18, is L1, and the amount by which the toner delivery portion 30 protrudes into the storage portion 18 from the inward surface 18*a* (downstream inward wall 18*a*1 in terms of direction in which toner delivery portion 30 is inserted) to which the toner sensor 17 is attached, is L2. In this embodiment, the image forming apparatus 100 and toner cartridge 14 therefor are structured so that "$0.3 \times L1 < L2 < 0.5 \times L1$" is satisfied. Also in this embodiment, they are structured so that with reference to the horizontal plane which coincides with the toner sensor 17, the toner outlet 31 will be at the center of the storage portion 18 in terms of the left-right direction. That is, as the toner is discharged from the opening of the toner outlet 31, it falls into the storage portion 18 following a roughly parabolic trajectory. In this embodiment, therefore, the amount L of protrusion is set to a value within the above-described range so that the toner is discharged to roughly the center of the storage portion 18.

However, in a case where the image forming apparatus 100 and the toner cartridge 14 therefor are structured so that as the toner delivery portion 30 of the toner cartridge 14 enters the storage portion 18, it sometimes occurs that the portion of the toner delivery portion 30 inserted into the storage portion 18 is soiled by the toner. Referring to part (c) of FIG. 20, this problem occurs because, as toner is delivered into the storage portion 18 from the toner cartridge 14, the toner sometimes scatters in the storage portion 18, and adheres to the toner delivery portion 30, and/or as the toner accumulates in the storage portion 18, the toner delivery portion 30 comes into contact with the body of the accumulated toner.

In this embodiment, therefore, the storage portion 18 is provided with a shielding porting 32, which shields the toner delivery portion 30 from the toner in the storage portion 18, in order to prevent the toner in the storage portion 18 from adhering to the outward surface of the toner delivery portion 30.

6. Shielding Portion

First, referring to FIG. 19, the shielding portion 32 with which the storage portion 18 is provided is described about its overall structure. Part (a) of FIG. 19 is a schematic sectional view of a combination of the storage portion 18 provided with the shielding portion 32, and the toner cartridge 14; the drawing on the right side of part (a) of FIG. 9 is a schematic sectional view of the combination as seen from the left side of the toner cartridge, whereas the drawing on the left side of the part (a) of FIG. 19 is a schematic sectional view of the combination as seen from rear side of the combination in terms of the direction in which the toner delivery portion 30 is inserted into the storage portion 18. By the way, parts (b) and (c) of FIGS. 19 are similar to part (a) of FIG. 19, except that they show other examples of the shielding portion 32, which will be described later.

Referring to part (a) of FIG. 19, the storage portion 18 is provided with the shielding portion 32 (protrusive wall) which covers at least a part of the downwardly facing portion, in terms of the gravity direction, of the portion of the toner delivery portion 30, which is in the storage portion 18. Thus, it is possible to prevent the problem that as the toner, etc., scatter in the storage portion 18, they adhere to the toner delivery portion 30.

Here, it is desired that the width of the shielding portion 32 in terms of the direction in which the toner delivery portion 30 is inserted into the storage portion 18 is greater than the width of the toner delivery portion 30 in terms of the horizontal direction. That is, when the width of the toner delivery portion 30 in terms of the horizontal direction, that is, in terms of the direction in which the toner delivery portion 30 is inserted into the storage portion 18 (external diameter of toner outlet 31) is D1, and the width of the shielding portion 32 in terms of the horizontal direction is D2, it is desired that "D1<D2" is satisfied. By the way, in terms of the horizontal direction, the shielding portion 32 is disposed so that the toner delivery portion 30 fits within the shielding portion 32. With the provision of the above-described structural arrangement, it is possible to more effectively prevent the problem that the toner, etc., adhere to the toner delivery portion 30 as they scatter in the storage portion 18.

Further, the storage portion 18 is structured so that, in terms of the direction in which the toner delivery portion 30 is inserted into the storage portion 18, the shielding portion 32 does not protrude beyond the toner outlet 31. That is, it is desired that the storage portion 18 is structured so that when the amount by which the toner delivery portion 30 protrudes from the above-described inward surface 18*a* is L2, and the amount by which the shielding portion 32 protrudes from the inward surface 18*a* is L3, "L2>L3" is satisfied. With the provision of the above-described structural arrangement, it is possible to prevent the problem that as the toner is discharged from the toner outlet 31, it accumulates on the shielding portion 32. However, it is preferred that "L2×0.8<L3" is satisfied. With the provision of this structural arrangement, it is possible to enhance the shielding portion 32 in its effect of preventing the toner from adhering to the toner delivery portion 30, while preventing the toner from accumulating on the shielding portion 32.

By the way, it is desired that in terms of the direction in which the toner delivery portion 30 is inserted into the storage portion 18, the shielding portion 32 is contiguous from the inward surface 18*a*of the storage portion 18 to the end of the toner outlet 31. With the provision of this structural arrangement, it is possible to prevent the problem that as the toner, etc., scatter in the storage portion 18, they adhere to toner delivery portion 30 across roughly the entire range of the toner delivery portion 30, that is, from its base portion, which is next to the inward surface 18*a*, to the adjacencies of the toner outlet 31.

As described above, by structuring the storage portion 18 so that the shielding portion 32 covers at least a part of the downwardly facing portion of the toner delivery portion 30 in terms of the gravity direction, it is possible to obtain the above-described effect. However, it is desired that the storage portion 18 is structured so that the shielding portion 32 covers the entirety of the toner delivery portion 30 in terms of the circumferential direction of the toner delivery portion 30, as seen from the direction in which the toner delivery portion 30 is inserted into the storage portion 18, as shown in part (b) of FIG. 19. With the provision of this structural arrangement, it is possible to prevent that problem that as the toner, etc., scatter in the storage portion 18, they adhere to the entirety of the toner delivery portion 30 in terms of the circumferential direction of the toner delivery portion 30.

Next, referring to FIGS. 14-17, the shielding portion 32 in this embodiment is more concretely described about its structure. FIG. 16 is a sectional view of the hopper A as seen from the rear side of the hopper A. FIG. 17 is a sectional view of the hopper A as seen from the top side of the hopper A.

Referring to FIGS. 14 and 15, in this embodiment, the storage portion 18 is structured so that as the toner delivery portion 30 of the toner cartridge 14 is inserted into the storage portion 18, the shielding portion 32 (protrusive wall) of the storage portion 18 covers the peripheral surface of the toner delivery portion 30. Further, the storage portion 18 and the shielding portion 32 thereof are structured so that the above-described inequalities "D1<D2*a*" and "L2×0.8<L3<L2" are satisfied, and also, that the shielding portion 32 covers roughly the entirety of the peripheral surface of the toner delivery portion 30.

Next, referring to FIGS. 16 and 17, in this embodiment, when the toner outlet 31 of the toner cartridge 14 is opened or closed, the toner cartridge 14 is held by the rotational mechanism B with which the hopper A is provided. As described above, when the cap 15 is opened or closed, the toner delivery portion 30 is held by the cartridge holding member 35. In this embodiment, the hopper A is provided with the pair of cartridge holding members 35, which are disposed so that after the installation of the toner cartridge 14, they are on the left and right sides of the toner cartridge 14, one for one. Thus, the shielding portion 32 for covering the toner delivery portion 30 is provided with a pair of recesses, which are on the left and right portions of the shielding portion 32, one for one, in order to prevent the shielding portion 32 from interfering with the cartridge holding member 35. In other words, in this embodiment, the shielding portion 32 has: the first portion 32*a* for covering the downwardly facing portion of the toner delivery portion 30 in terms of the gravity direction; and the second portion 32*b* for covering the upwardly facing portion of the peripheral surface of the toner delivery portion 30 in terms of the gravity direction. By the way, in this embodiment, the hopper A is structured so that the shielding portion 32 is disposed to cover roughly the entirety of the peripheral surface of the toner delivery portion 30 with its first portion 32*a* and second portion 32*b*. However, the hopper A may be structured so that the shielding portion 32 covers only the bottom half of the peripheral surface of the toner delivery portion 30 in terms of the gravity direction (that is, shielding portion 32 has only first portion 32*a*).

As described above, in this embodiment, in order to store as much toner as possible in the storage portion 18 which is relatively small, the combination of the toner cartridge 14 and hopper A is structured so that as the toner cartridge 14 is installed into the apparatus main assembly 115, the toner delivery portion 30 of the toner cartridge 14 is inserted into the storage portion 18, and also, so that the toner outlet 31 is positioned roughly in the center of the storage portion 18. In this embodiment, not only are the image forming apparatus 100 and the toner cartridge 14 therefor structured as described above, but also, the storage portion 18 is provided with the shielding portion 32 for covering the toner delivery portion 30. Therefore, it is possible to prevent the problem that as the toner, etc., scatter in the storage portion 18, they adhere to the toner delivery portion 30, while keeping the image forming apparatus 100 (more specifically, toner cartridge 14 and hopper A) relatively simple in structure, and therefore, relatively low in cost. Thus, it is possible to prevent the cartridge tray 26 of the apparatus main assembly 115 from being soiled by the toner, and/or prevent the problem that the soiling of the cartridge tray 26 and toner cartridge 14 by the toner is worsened by the repeated insertion and extraction of the toner cartridge 14.

[Embodiment 2]

Next, another embodiment of the present invention is described. In terms of basic structure and operation, the image forming apparatus in this embodiment is the same as that in the first embodiment. Therefore, the elements of the image forming apparatus in this embodiment, which are the same in function or structure are given the same referential codes as the counterparts in the first embodiment, and are not described in detail.

In this embodiment, the storage portion 18 is provided with a shielding portion 32 (protrusive wall), which is formed so that as the toner delivery portion 30 of the toner cartridge 14 is inserted into the storage portion 18, the peripheral surface of the toner delivery portion 30 of the toner cartridge 14 is covered by the shielding portion 32 as in the first embodiment. This embodiment is different from the first embodiment in that a sealing member 34 is disposed between the shielding portion 32 and toner delivery portion 30 as shown in part (c) of FIG. 19.

Referring to FIG. 18, the sealing member 34 is more concretely described about its structure. FIG. 18 is a sectional view of the sealing member 34 of the hopper A, and its adjacencies, as seen from the right side of the hopper A. In this embodiment, the shielding portion 32, which will be in the adjacencies of the toner outlet 31 after the installation of the toner cartridge 14 into the apparatus main assembly 115, is provided with the sealing member 34. More specifically, roughly the entirety of the inward surface (inward surface of first portion 32*a* and inward surface of second portion 32*b*, in FIG. 16) of the shielding portion 32 in terms of the circumferential direction of the shielding portion 32 is provided with the sealing member 34. In this embodiment, the sealing member 34 is formed of a foamed elastic substance. This sealing member 34 seals between the shielding portion 32 and toner delivery portion 30 by coming into contact with the front surface of the holdable portion 30*b* of the end portion of the toner delivery portion 30. By the way, when the toner cartridge 14 is inserted into, or pulled out of, the hopper A, the holdable portion 30*b* passes by the sealing member 34 by causing the sealing member 34 to deform.

By the way, in case where the shielding portion 32 is formed so that it contiguously covers the entirety of the peripheral surface of the toner delivery portion 30 in terms of the circumferential direction of the toner cartridge 14, as shown in part (c) of FIG. 19, the sealing member 34 may be shaped like a ring to be placed between the shielding portion 32 and toner delivery portion 30.

By providing the storage portion 18 with the sealing member 34 as described above, it is possible to prevent the problem that as the toner, etc., scatter in the storage portion 18, they enter between the toner delivery portion 30 and shielding portion 32. Therefore, it becomes possible to prevent the problem that the toner, etc., scatter in the storage portion 18, and adhere to the peripheral surface of the toner delivery portion 30 and/or inward surface of the shielding portion 32 in terms of the radius direction of the shielding portion 32. Further, the hopper A is provided with the sealing member 34. Therefore, it is possible to realize such an effect that as the toner cartridge 14 is inserted into, or pulled out of, the hopper A, the toner having adhered to the portion of the toner delivery portion 30, which is on the inward side of the sealing member 34 in the storage portion 18, is scraped way.

[Miscellanies]

In the foregoing, the present invention was described with reference to concrete embodiments of the present invention. However, the preceding embodiments are not intended to limit the present invention in scope.

In the embodiments described above, the developer delivered to the developer hopper from the replenishment developer container was toner. However, the developer to be delivered from the replenishment developer container to the developer hopper may be two-component developer which includes toner and carrier. Further, in a case where an electrophotographic image forming is structured so that toner and carrier are separately delivered to the developing apparatus, the developer to be delivered from the replenishment developer container to the developer delivering apparatus may be nothing but carrier.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-091307 filed on Apr. 28, 2016, which is hereby incorporated by reference herein in its entirety.

What is claimed is:

1. An image forming apparatus for forming an image on a recording material using toner, said apparatus comprising:

a main assembly;

an image developer unit configured to develop an electrostatic latent image formed on an image bearing member, using the toner;

a toner container detachably mounted to said main assembly, said toner container containing the toner and provided with a toner discharging portion including a discharge opening configured to discharge the toner from said toner container;

a storage container configured to store the toner discharged through said discharge opening and to supply the stored toner into said image developer unit, wherein said toner discharging portion extends at least partly in said storage container through an opening of said storage container; and a cover configured to cover said toner discharging portion and extending inwardly from an inside of a wall of said storage container, which wall is provided with said opening, at least below said toner discharging portion, wherein a length L1 by which said cover extends from said wall inwardly of said storage container with respect to a mounting direction in which said toner container is mounted to a mounting portion, and a length L2 by which said toner discharging portion extends from said opening inwardly of said storage container satisfy L1<L2.

2. The image forming apparatus according to claim 1, wherein said toner discharging portion is cylindrical, and said cover is cylindrical, with said cover surrounding an entire circumference of said toner discharging portion.

3. The image forming apparatus according to claim 1, wherein said toner discharging portion is cylindrical, and said cover is cylindrical, and an outer diameter D1 of the toner discharging portion and an outer diameter D2 of said cover satisfy:

D1<D2.

4. The image forming apparatus according to claim 1, wherein L2×0.8<L1<L2.

5. The image forming apparatus according to claim 1, further comprising a sealing member provided between said toner discharging portion when said cover to seal part of a space therebetween.

* * * * *